US007052449B2

(12) United States Patent
Chen

(10) Patent No.: US 7,052,449 B2
(45) Date of Patent: May 30, 2006

(54) GYM BOARD

(76) Inventor: Ping Chen, No. 29, Nanmei St., Nantun Li, Nantun Dist., Taichung (TW)

( * ) Notice: Subject to any disclaimer, the term of this patent is extended or adjusted under 35 U.S.C. 154(b) by 246 days.

(21) Appl. No.: 10/803,702

(22) Filed: Mar. 18, 2004

(65) Prior Publication Data

US 2005/0209073 A1 Sep. 22, 2005

(51) Int. Cl.
*A63B 22/14* (2006.01)

(52) U.S. Cl. ..... 482/146; 482/142

(58) Field of Classification Search ..... 482/146, 482/147, 79, 80, 140, 42, 52; 108/157.1, 108/156, 153.1, 12, 19, 43; 248/188.2; 446/396, 446/325, 326, 316, 317, 322
See application file for complete search history.

(56) References Cited

U.S. PATENT DOCUMENTS

| | | | | | |
|---|---|---|---|---|---|
| D255,372 | S | * | 6/1980 | Tidmore | D21/688 |
| 4,601,469 | A | * | 7/1986 | Sasser, Jr. | 482/146 |
| 5,269,735 | A | * | 12/1993 | Pfitzenmeier | 482/52 |
| 5,441,466 | A | * | 8/1995 | Piaget et al. | 482/52 |
| 5,540,638 | A | * | 7/1996 | Wilkinson | 482/52 |
| 5,810,703 | A | * | 9/1998 | Stack | 482/146 |
| 6,926,643 | B1 | * | 8/2005 | Gvoich | 482/52 |

* cited by examiner

*Primary Examiner*—Stephen K. Cronin
*Assistant Examiner*—Allana Lewin
(74) *Attorney, Agent, or Firm*—William E. Pelton, Esq.

(57) ABSTRACT

A gym board has a board and an insert body mounted on the board. The board has a bottom surface, a center holder and at least two side holders. The insert body has four insert blocks and each insert block can be mounted in the center holder and the side holders.

14 Claims, 9 Drawing Sheets

GYM BOARD

BACKGROUND OF THE INVENTION

1. Field of the Invention

The present invention relates to a gym board, and more particularly to a gym board that can be used for conditioning in many sports as well as general body conditioning.

2. Description of Related Art

Usually, a conventional gym board has a single purpose and is used to condition a single portion on a body. Consequently, a conventional gym board cannot be used for conditioning in many sports and all portions of the body.

A gym board in accordance with the present invention obviates or mitigates the aforementioned problems.

SUMMARY OF THE INVENTION

The primary objective of the present invention is to provide a gym board that can be used for conditioning in many sports.

The gym board in accordance with the present invention has a board and an insert body movable mounted on the board. The board has a bottom surface, a center holder and at least two side holders. The insert body has four insert blocks and each insert block can be movable mounted in the center holder and the side holders.

Other objectives, advantages and novel features of the invention will become more apparent from the following detailed description when taken in conjunction with the accompanying drawings.

DETAILED DESCRIPTION OF PREFERRED EMBODIMENT

Figure 1:
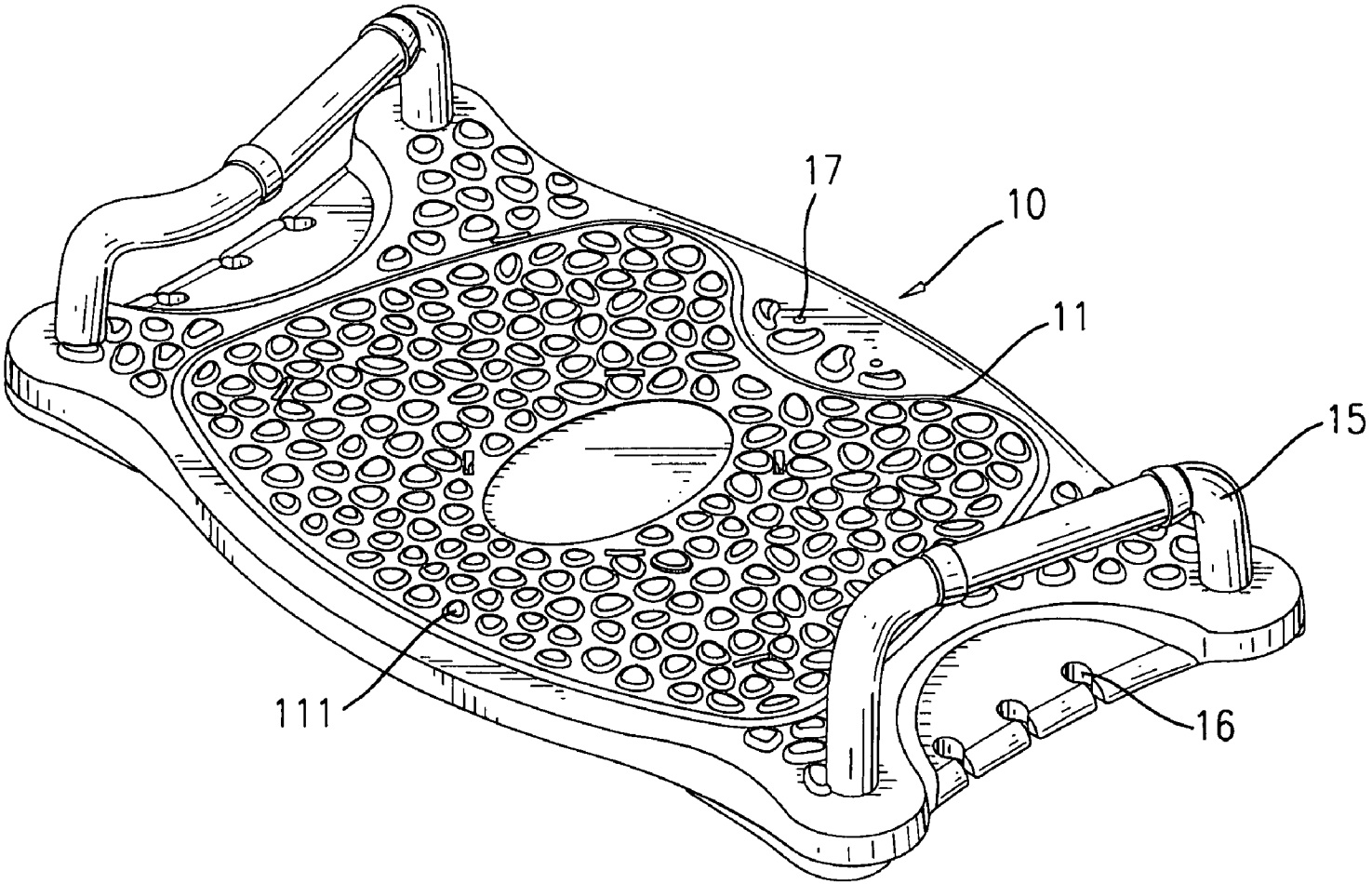
FIG. 1 is a perspective view of a gym board in accordance with the present invention.
Figure 2:
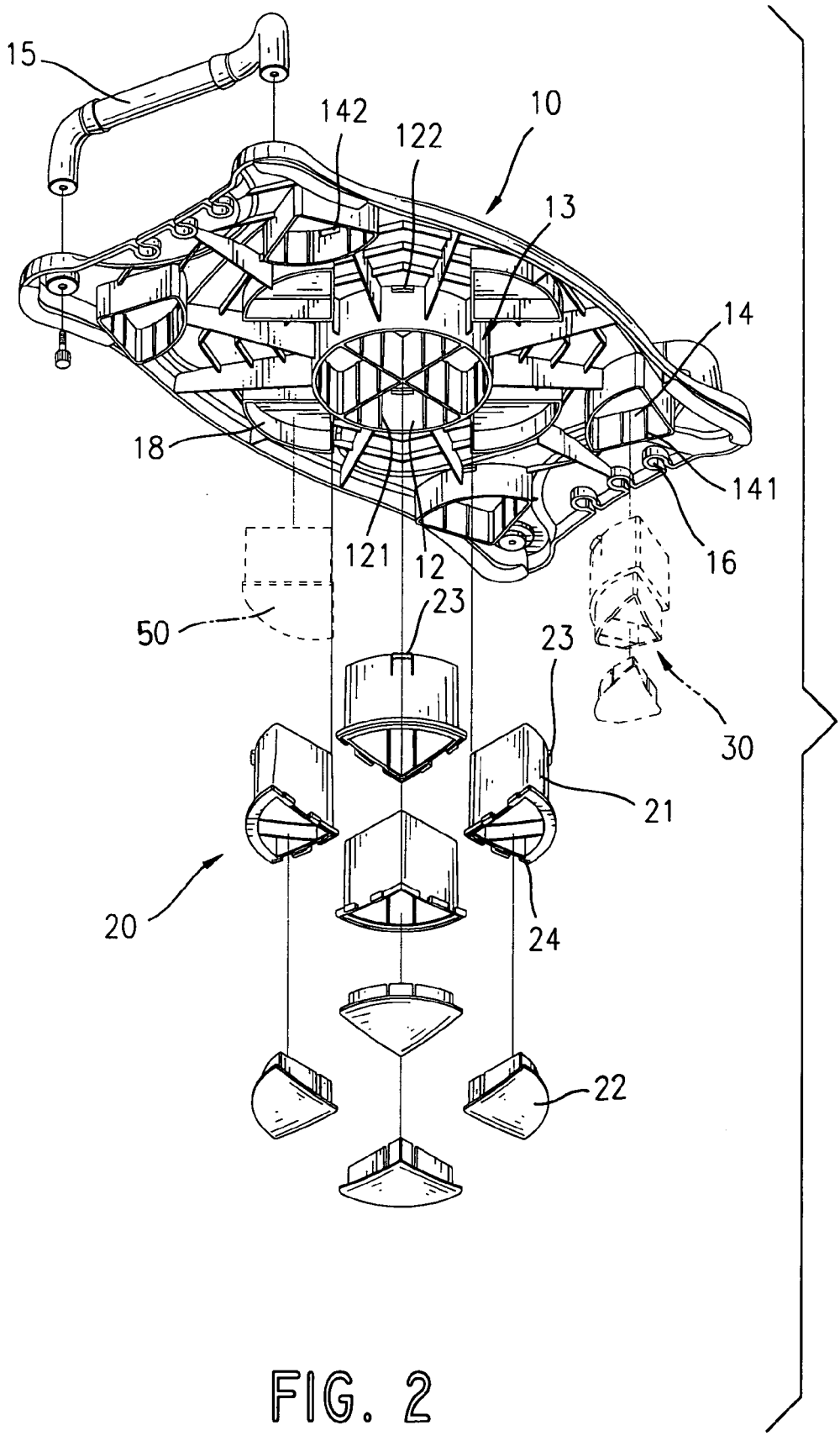
FIG. 2 is an exploded perspective view of the gym board in FIG. 1.
Figure 5:
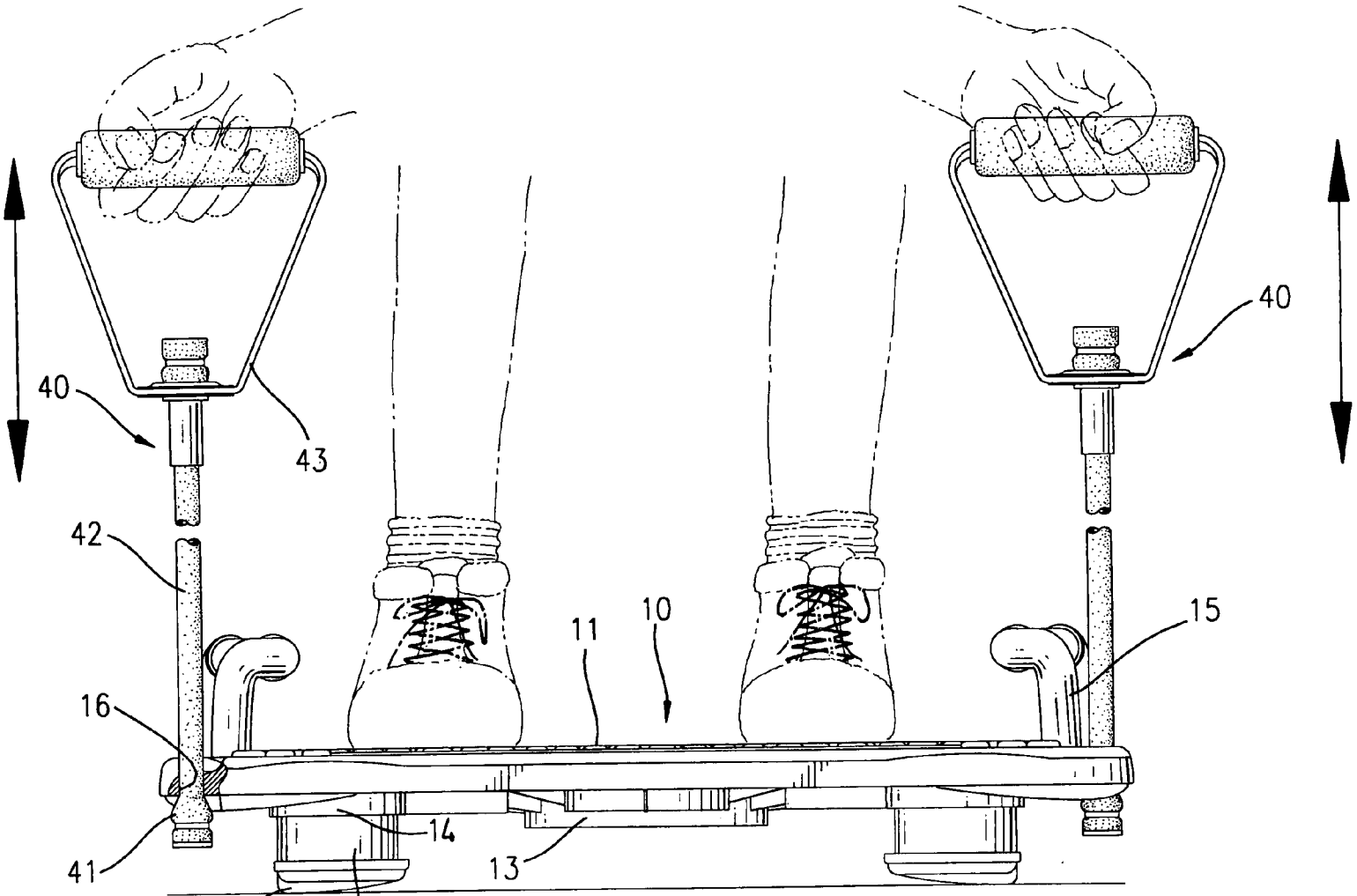
FIG. 5 is an operational front plan view of the gym board in FIG. 1 being used to perform curls.

With reference to FIGS. 1, 2 and 5, a gym board in accordance with the present invention can be used for conditioning in many sports and has a board (10), an insert body (20), at least two optional holding bodies (30), at least two optional quarters (50) and two optional resilient cords (40).

The board (10) has a top surface (not numbered), a bottom surface (not numbered), multiple edges (not numbered), multiple corners (not numbered), a center (not numbered), an traction area (11), multiple optional nubs (111), two optional handles (15), at least two slotted holes (16), two optional through holes (17), a center holder (13), at least two side holders (14) and at least two optional quarter holders (18). The gym board described for illustrative purposes has four edges and four corners, and the board (10) is rectangular.

The optional handles (15) are respectively mounted on the top surface along two opposite edges. Each handle (15) has two ends (not numbered), and a screw (not numbered) is mounted through the board (10) and screws into the end of the handle (15).

The traction area (11) is formed on the top surface between two handles (15).

The optional slotted holes (16) are respectively defined through the edges corresponding to the handles (15).

The optional nubs (111) are formed on the traction area (11) and used for preventing a user from slipping.

The two optional through holes (17) are defined through the board (10) at one of the edges different from the edge corresponding to the handles (15) and used to attach one end of the handles (15) so the direction and orientation of the handles (15) can be changed.

The center holder (13) is formed on the bottom surface of the board (10) at the center. The center holder (13) is cylindrical and has four equal recesses (12). Each recess (12) has multiple optional ribs (121) and an optional key lock (122).

The side holders (14) are formed on the bottom surface of the board (10) respectively near the corners. Each side holder (14) is shaped the same as one of the recesses (12) and has a tip (not numbered). The tip of each side holder (14) points toward the corresponding corner. The gym board as described for illustrative purposes has four side holders (14).

The optional quarter holders (18) are formed around the center holder (13), and each quarter holder (18) is shaped the same as one of the recesses (12) and equal to each recess (12). The gym board as described for illustrative purposes has four quarter holders (18) arranged radially around the center holder (13).

The insert body (20) is movable mounted inside the center holder (13) and has four insert blocks (21). Each insert block (21) mounts in the corresponding recess (12) and has a top (not numbered), a bottom (not numbered), a bottom side edge (not numbered), a side surface (not numbered), a height (not numbered), a cap (22), a key (23) and multiple optional hooks (24). The cap (22) is mounted on the bottom of the insert block (21), and the optional hooks (24) are formed on the bottom side edge for holding the cap (22). The key (23) is formed on the side surface at the top and faces the corresponding key lock (122).

The optional holding bodies (30) are mounted inside the side holders (14), and each holding body (30) has a bottom (not numbered), a top (not numbered), a height (not numbered), a top block (not numbered) and bottom block (not numbered). The top block is integrally formed on the bottom block, and the cap is mounted on the bottom of the holding body (30). The bottom block of the holding body (30) is mounted in the side holder (14).

The optional quarters (50) are almost the same as the insert blocks (21) except for the cap (22). The quarter (50) is mounted in the quarter holder (18) and has an arcuate cap (not numbered). The quarter (50) also can be inserted into one of the recesses (12) or the side holder (14).

The optional resilient cords (40) are respectively mounted through the slotted holes (16), and each resilient cord (40) has an elastic cord (42) and a handle (43). The elastic cord (42) has a distal end (not numbered) and a proximal end (41). The handle (43) is mounted on the distal end of the elastic cord (42).

Figure 3:
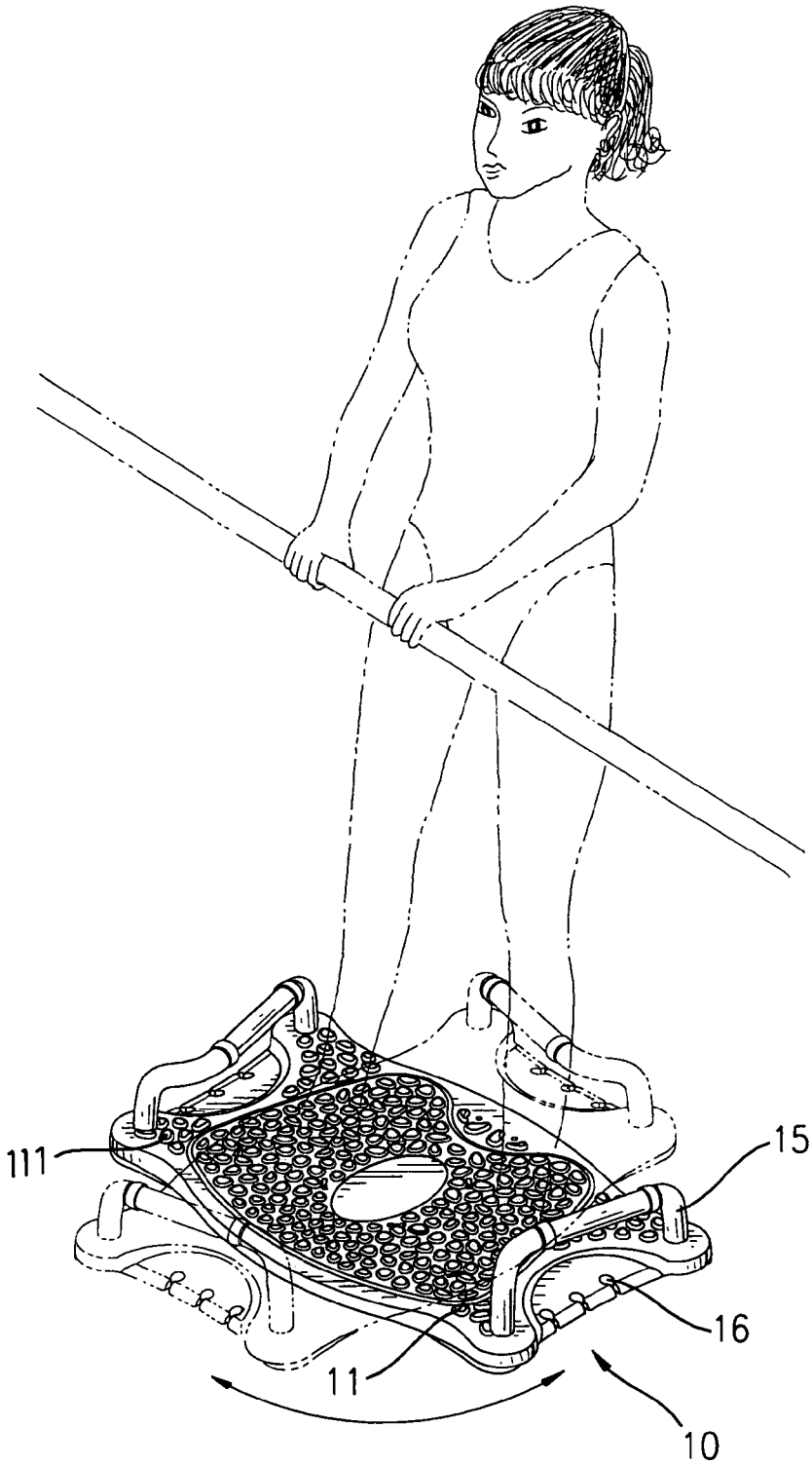
FIG. 3 is an operational perspective view of the gym board in FIG. 1 being used for balance training.
Figure 4:
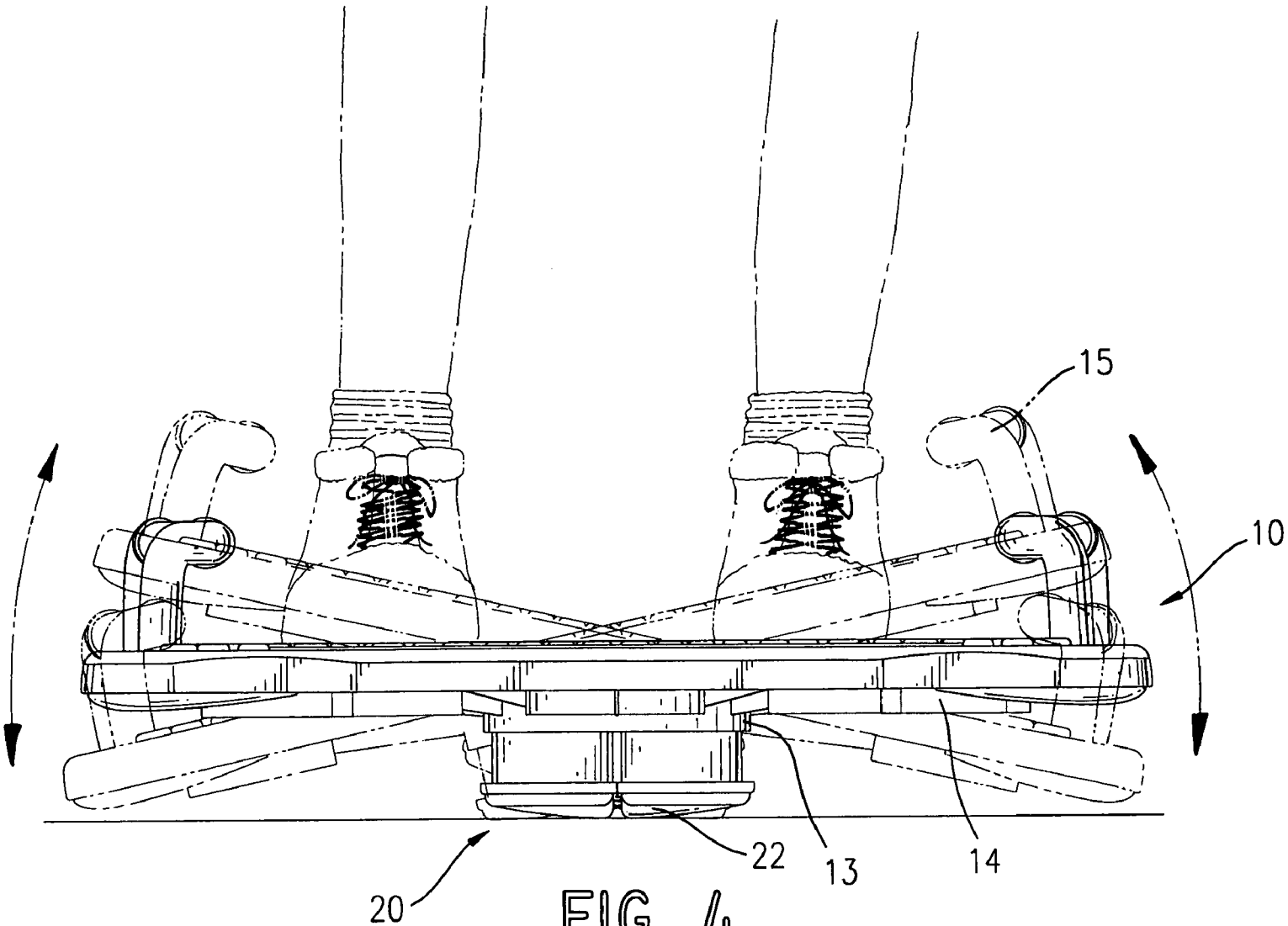
FIG. 4 is an operational front plan view of the gym board in FIG. 1 being used for balance training.

With reference to FIG. 3, when the insert body (20) is mounted inside the center holder (13), a user can stand on the traction area (11) of the gym board and rock the gym board in any direction. The nubs (111) keep the user from slipping. With reference to FIG. 4, a user can rock the gym board to improve the sense of balance.

With reference to FIG. 5, when the resilient cords (40) are respectively mounted through the slotted holes (16) and the insert blocks (21) are removed from the center cylinder (13) and inserted into the corresponding side holders (14), a user can stand on the gym board and pull the resilient cords (40) to strengthen arms.

Figure 6:
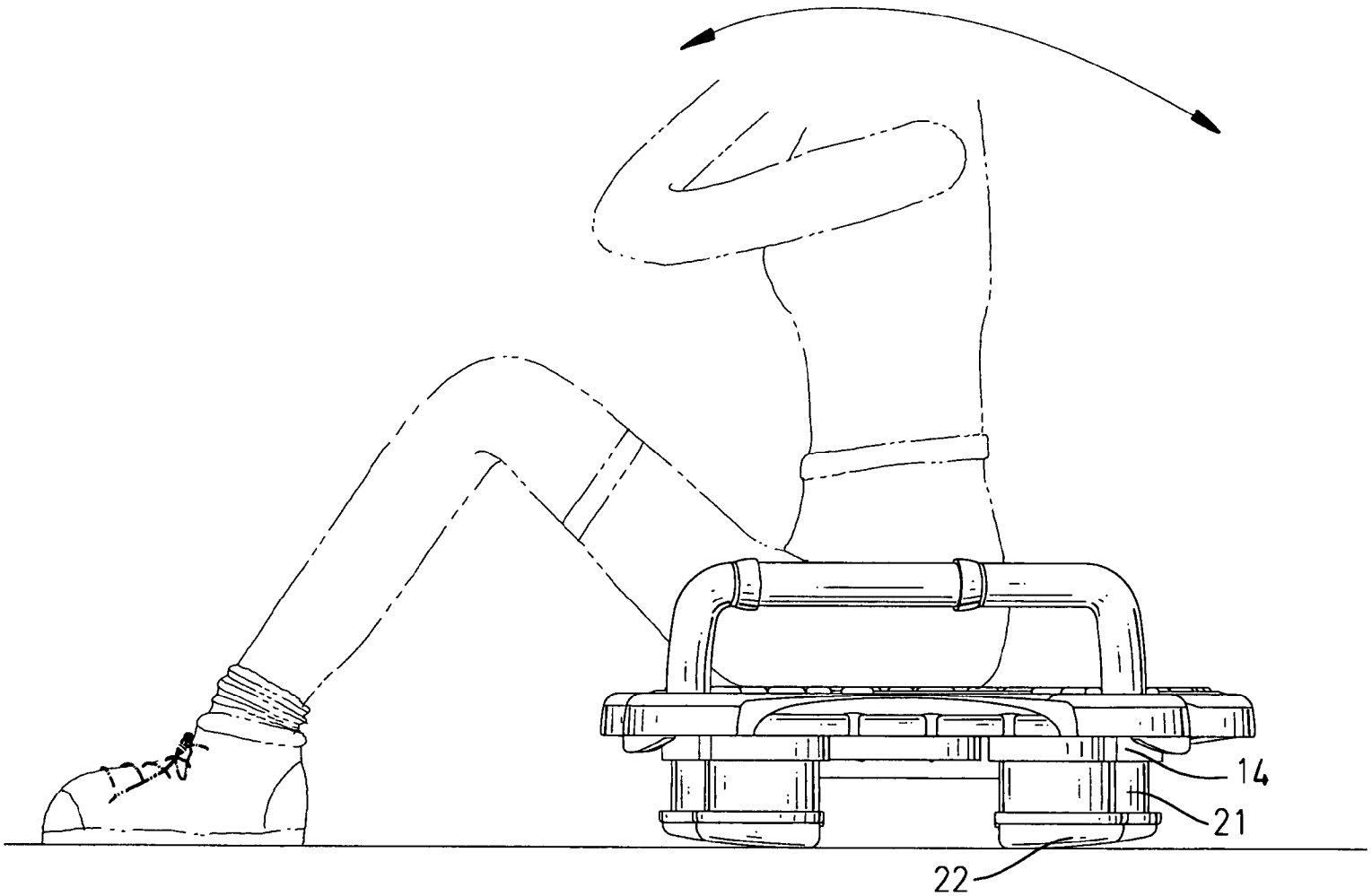
FIG. 6 is an operational side plan view of the gym board in FIG. 1 being used to perform extended sit-ups.
Figure 7:
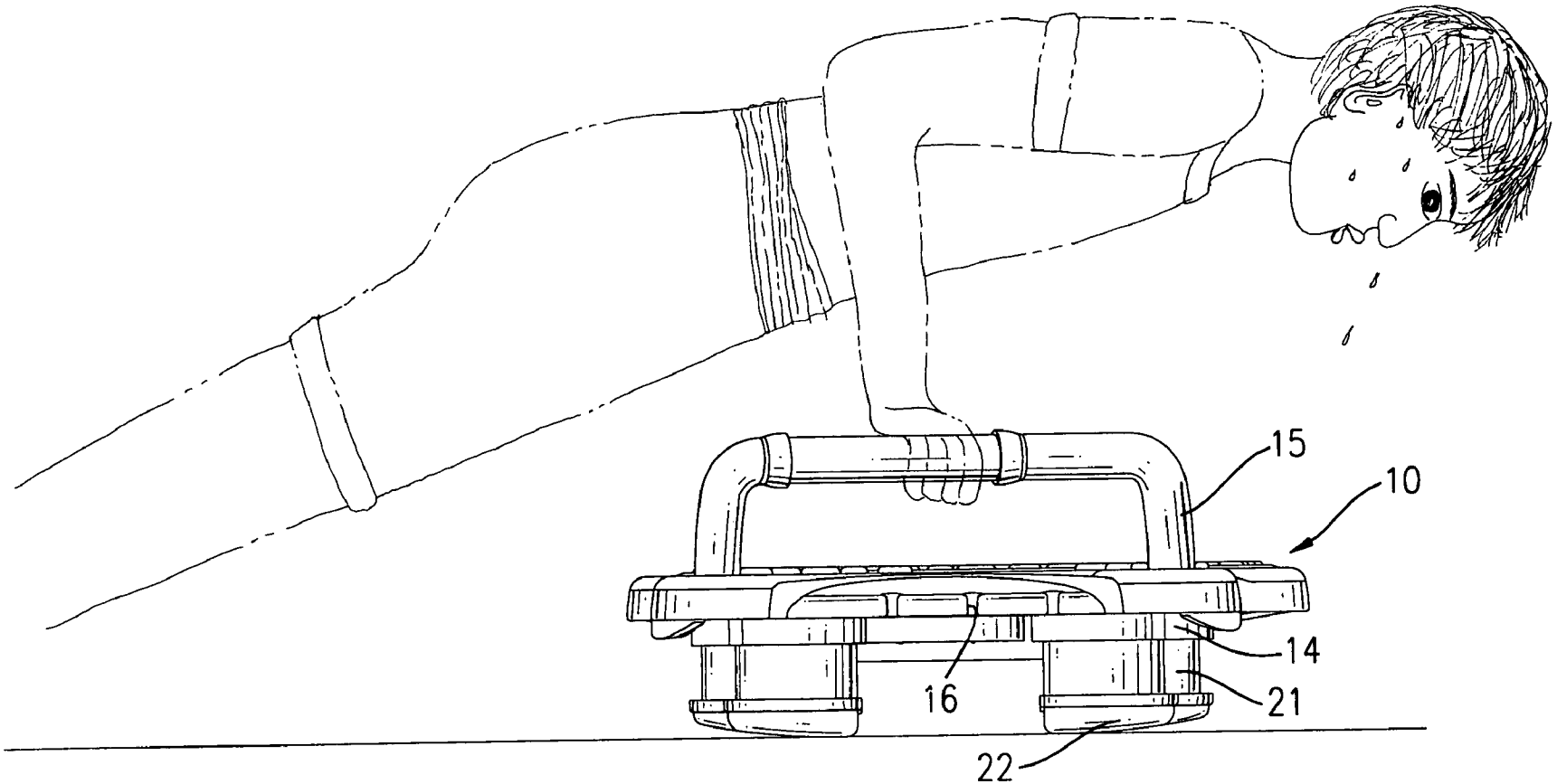
FIG. 7 is an operational side plan view of the gym board in FIG. 1 being used to perform push-ups.

With reference to FIGS. 6 and 7, a user can sit on the traction area (11) to do sit-ups exercise or do push-up exercise when the resilient cords (40) are removed.

Figure 8:
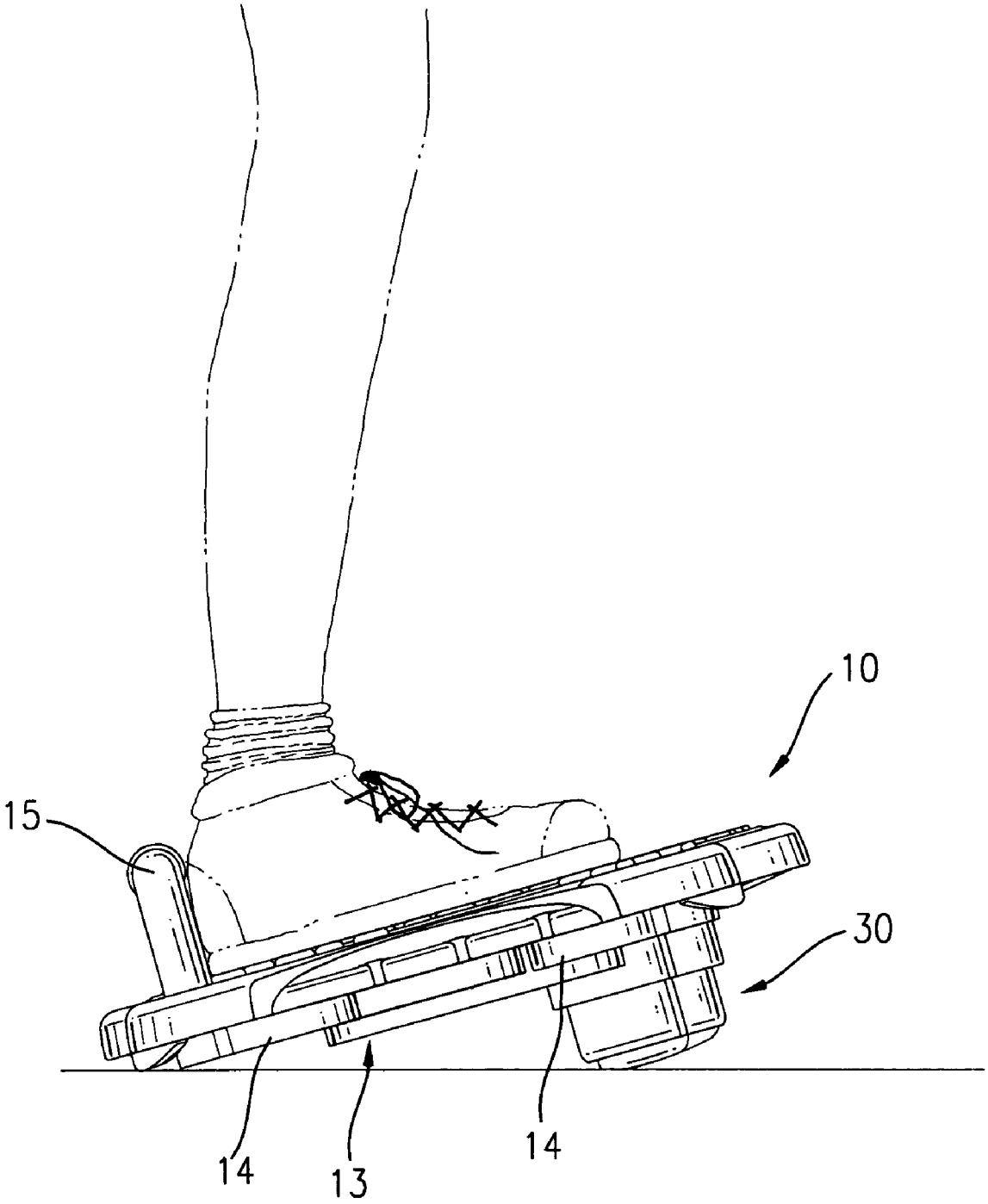
FIG. 8 is an operational side plan view of the gym board in FIG. 1 being used to raise a person's toes during exercises.

With reference to FIG. 8, the gym board is inclined by removing the insert body (20) from the center holder (13) and inserting holding bodies (30) into two of the side holders (14). One end of each handle (15) is loosened and rotated to change the direction of the handle (15). A user stands on the gym board, and the heels of the user's feet respectively abut the handles (15) so that the user will not slip from the gym board and exercise the leg muscles.

Figure 9:
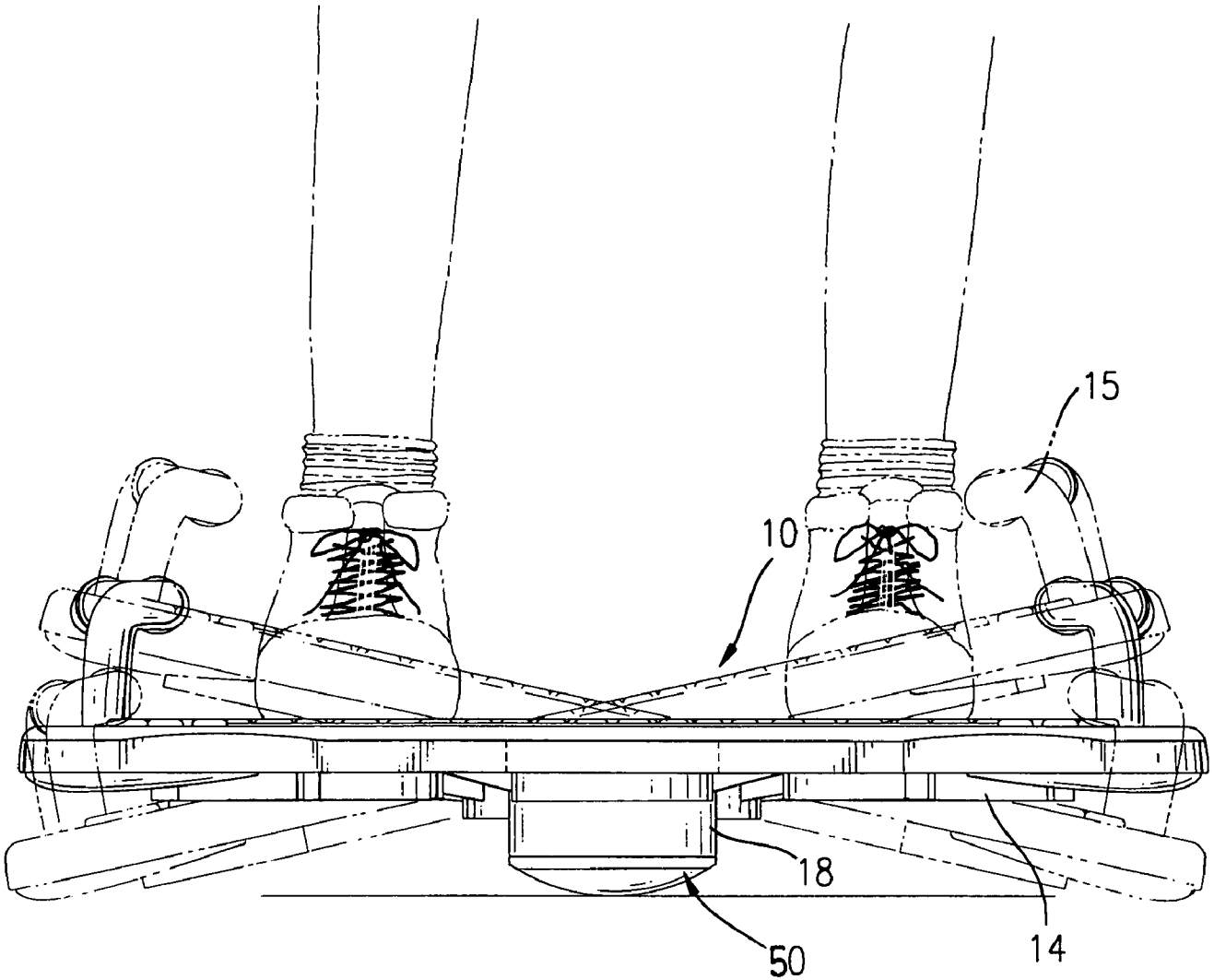
FIG. 9 is an operational side plan view of the gym board in FIG. 1 being used to perform a seesaw exercise.

With reference to FIG. 9, a single axis balancing device is configured by inserting the quarters (50) into two opposite quarter holders (18) so a user standing on the gym board to do a seesaw exercise.

The gym board in accordance with the present invention provides the means to perform multiple exercises and condition multiple parts of a user's body.

The invention may be varied in many ways by a person skilled in the art. Such variations are not to be regarded as a departure from the spirit and scope of the invention, and all such modifications are intended to be included within the scope of the following claims.

What is claimed is:

1. A gym board comprising
a board having
a top surface,
a bottom surface,
multiple edges,
multiple corners,
a center,
a traction area formed on the top surface,
a center holder formed on the bottom surface at the center and having multiple equal recesses, and
at least two side holders formed at the same edge, and each side holder equal to one of the recesses, each side holder formed at one of the corners, and
an insert body mounted inside the center holder and side holders, having
multiple insert blocks, each insert block having
a top selectively inserted into one of the recesses in the central holder and the at least two side holders,
a bottom side edge, and
a cap mounted on the bottom side edge.

2. The gym board as claimed in claim 1, wherein the board further comprises two handles mounted on the board along two opposite edges.

3. The gym board as claimed in claim 2, wherein the board further comprises at least two slotted holes, each slotted holes is defined through the edge corresponding to the handles.

4. The gym board as claimed in claim 3, wherein three slotted holes defined through each edge corresponding to the handles.

5. The gym board as claimed in claim 1, wherein the traction area of the board further comprises multiple nubs formed on the traction area.

6. The gym board as claimed in claim 1, wherein four side holders are formed on the bottom surface of the gym board.

7. The gym board as claimed in claim 1, wherein the board further comprises at least two quarter holders formed around the center holder, each quarter holder is shaped as one of the recesses and equal to one of the recess.

8. The gym board as claimed in claim 7, wherein four quarter holders are radial arranged around the center holder.

9. The gym board as claimed in claim 3, wherein the gym board further comprises two resilient cords mounted through the slotted holes.

10. The gym board as claimed in claim 1, wherein the gym board further comprises at least two holding bodies mounted inside the side holders.

11. The gym board as claimed in claim 6, wherein the gym board further comprises four holding bodies mounted inside the side holders.

12. The gym board as claimed in claim 7, wherein the gym board further comprises at least two quarters mounted in the quarter holders.

13. The gym board as claimed in claim 8, wherein the gym board further comprises four quarters mounted inside the quarter holders.

14. The gym board as claimed in claim 9, wherein each resilient cord has
an elastic cord having
a distal end, and
a proximal end selectively mounted inside one of the slotted holes in the board, and
a handle mounted on the distal end of the elastic cord.

* * * * *